US008649705B2

(12) United States Patent
Nozawa et al.

(10) Patent No.: US 8,649,705 B2
(45) Date of Patent: Feb. 11, 2014

(54) DEVELOPING APPARATUS AND IMAGE FORMING APPARATUS

(75) Inventors: Ken Nozawa, Minato-ku (JP); Yukiyoshi Oda, Minato-ku (JP)

(73) Assignee: Oki Data Corporation, Tokyo (JP)

( * ) Notice: Subject to any disclaimer, the term of this patent is extended or adjusted under 35 U.S.C. 154(b) by 182 days.

(21) Appl. No.: 13/014,960

(22) Filed: Jan. 27, 2011

(65) Prior Publication Data

US 2011/0188886 A1 Aug. 4, 2011

(30) Foreign Application Priority Data

Jan. 29, 2010 (JP) ..... 2010-019038

(51) Int. Cl.
*G03G 21/16* (2006.01)
*G03G 15/04* (2006.01)

(52) U.S. Cl.
USPC ..... 399/111; 399/119

(58) Field of Classification Search
USPC ..... 399/110, 111, 358, 360
See application file for complete search history.

(56) References Cited

U.S. PATENT DOCUMENTS

| | | | | |
|---|---|---|---|---|
| 2006/0228131 | A1 | 10/2006 | Kimura et al. | |
| 2008/0159775 | A1 | 7/2008 | Koishi et al. | |
| 2009/0010677 | A1 * | 1/2009 | Yang | 399/110 |
| 2009/0220273 | A1 | 9/2009 | Tomatsu | |
| 2010/0322664 | A1 | 12/2010 | Matsuda | |

FOREIGN PATENT DOCUMENTS

| | | | |
|---|---|---|---|
| EP | 1746468 | A1 | 1/2007 |
| JP | 03-084564 | A | 4/1991 |
| JP | 11-135095 | A | 5/1999 |
| JP | 2006-079128 | A | 3/2006 |
| JP | 2006106513 | A | 4/2006 |
| JP | 2008-203566 | A | 9/2008 |
| JP | 4-384251 | B1 | 12/2009 |
| JP | 2010-008810 | A | 1/2010 |

OTHER PUBLICATIONS

EP Search Report issued May 11, 2011 in EP Application No. 11152209.0.

* cited by examiner

*Primary Examiner* — David Gray
*Assistant Examiner* — Erika J Villaluna
(74) *Attorney, Agent, or Firm* — Panitch Schwarze Belisario & Nadel LLP

(57) ABSTRACT

A developing apparatus is used in an electrophotographic image forming apparatus. Developing units form corresponding developer images. A frame holds the developing units therein in position so that the developing units are movable independently by a distance relative to the frame. An urging member is disposed across the frame and each developing unit and urges each developing unit against the frame. An elastic sealing member secured to the frame and in intimate contact with each of the developing units when the corresponding developing unit is attached to the frame. The sealing member seals a gap between the frame and each of the developing unit.

16 Claims, 18 Drawing Sheets

DEVELOPING APPARATUS AND IMAGE FORMING APPARATUS

BACKGROUND OF THE INVENTION

1. Field of the Invention

The present invention relates to a developing apparatus equipped with a plurality of developing units, and an image forming apparatus to which the plurality of developing units are attached.

2. Description of the Related Art

A plurality of developing units are employed in electrophotographic image forming apparatus including printers, copiers, and facsimile machines. The developing units are supported by a single mechanism in order to implement a small size apparatus and reduce user intervention in handling the developing units. Japanese Patent Application Publication No. 2006-106513 discloses one such apparatus.

However, supporting the developing units by a single mechanism presents a problem in that the developing units may not be moved independently by a small distance relative to the image forming apparatus body. For example, the respective developing units may not be moved individually to an idle position where the photoconductive body of a developing unit is not in contact with a corresponding transfer unit. However, if the developing units are moveable, then the mechanical and electrical connection between the image forming apparatus body and the developing units may not be maintained appropriately.

SUMMARY OF THE INVENTION

The present invention was made in view of the above-described drawbacks.

An object of the invention is to provide a configuration in which developing units may be moved independently by a small distance independently relative to the apparatus body.

Another object of the invention is to solve drawbacks resulting from the configuration in which the developing units may be moved by a small distance.

A developing apparatus is used in an electrophotographic image forming apparatus. Developing units form corresponding developer images. A frame holds the developing units therein in position so that the developing units are movable independently by a distance relative to the frame. An urging member is disposed across the frame and each developing unit and urges each developing unit against the frame. An elastic sealing member secured to the frame and in intimate contact with each of the developing units when the corresponding developing unit is attached to the frame. The sealing member seals a gap between the frame and each of the developing unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiment

Figure 1:
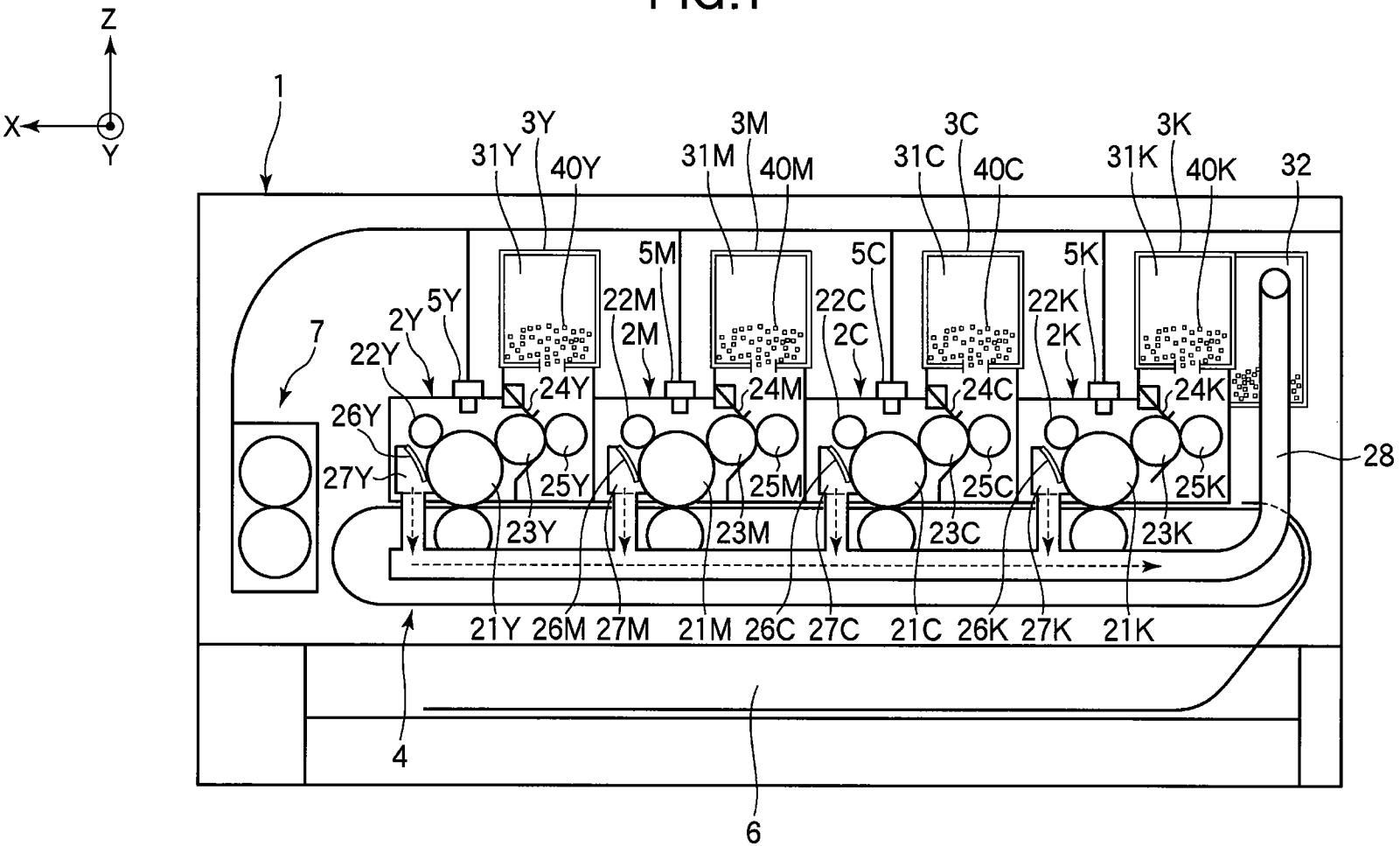
FIG. 1 illustrates then outline of an image forming apparatus with a developing apparatus according to the present invention.

FIG. 1 illustrates the outline of an electrophotographic image forming apparatus 1 with a developing apparatus 50 according to the present invention.

The image forming apparatus 1 includes four developing units 2K, 2Y, 2M, and 2C which form black, yellow, magenta, and cyan images, respectively; toner cartridges 3K, 3Y, 3M, and 3C that hold toners of corresponding colors; a transfer unit 4; LED heads 5K, 5Y, 5M, and 50 or exposing units; a paper cassette 6 that holds a stack of paper therein and feeds the paper on a sheet-by-sheet basis into a transport path; and a fixing unit 7 that fixes the toner image on the paper.

Figure 2:
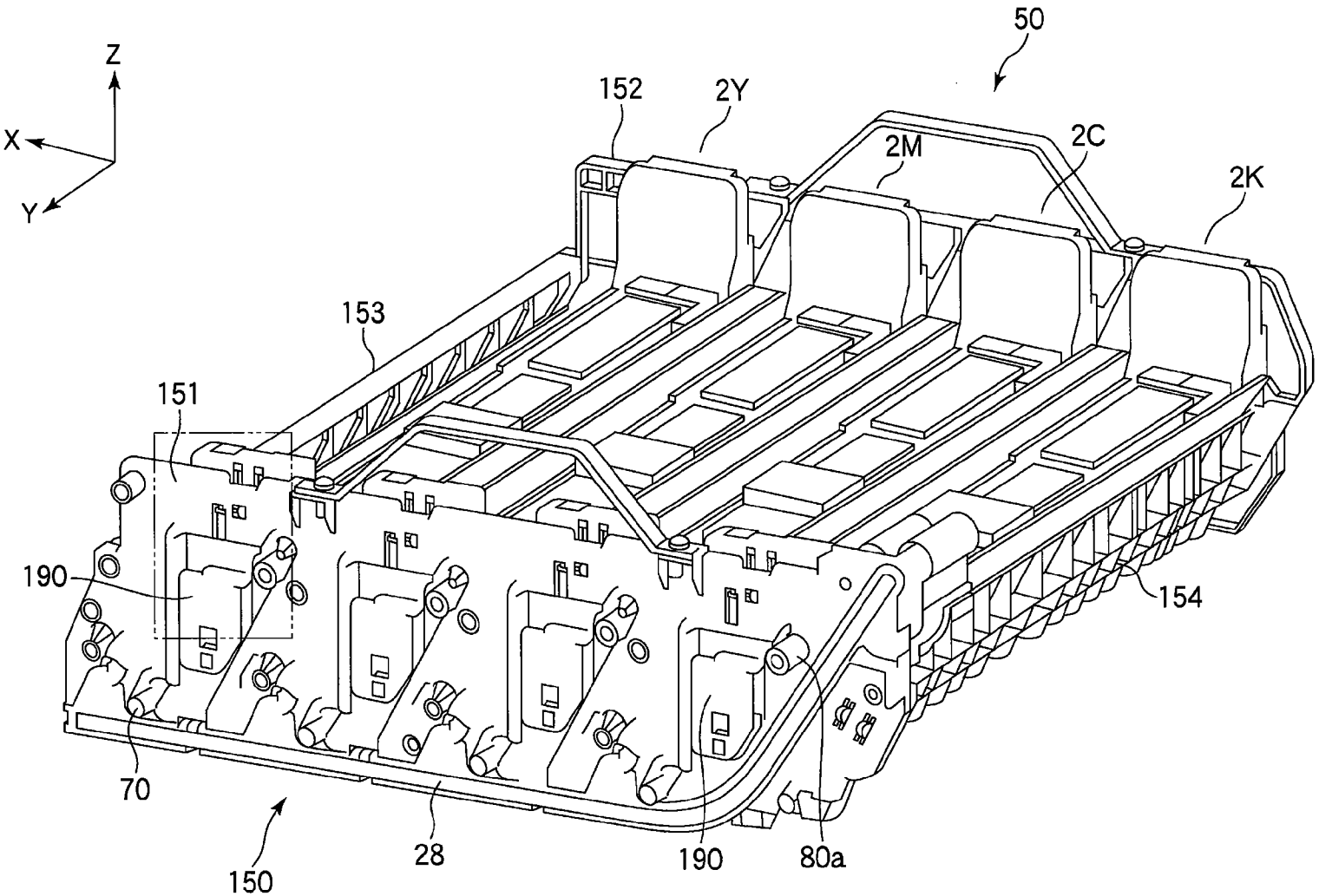
FIG. 2 is a perspective view of the developing apparatus according to an embodiment.

The developing units 2K, 2Y, 2M, and 2C are aligned along the transport path of the paper from upstream to downstream, and face the transfer unit 4. The developing units 2K, 2Y, 2M, and 2C are mounted in a basket 150 (FIGS. 5 and 6), so that they can be handled as a single unit or the developing apparatus 50 (FIG. 2). The developing apparatus 50 may be detachably attached to the body of image forming apparatus 1.

The toner cartridges 3K, 3Y, 3M, and 3C have toner chambers 31K, 31Y, 31M, and 31C that hold fresh toner 40K (black), 40Y (yellow), 40M (magenta), and 40C (cyan) therein, respectively. The toner cartridges 3K, 3Y, 3M, and 3C may be attached to the corresponding developing units 2K, 2Y, 2M, and 2C for supplying the fresh toners to the corresponding developing units.

The developing units 2K, 2Y, 2M, and 2C are substantially identical and differ from one another only in the color of toner. The developing units 2K, 2Y, 2M, and 2C include photoconductive bodies 21K, 21Y, 21M, and 21C; charging rollers 22K, 22Y, 22M, and 22C; developing rollers 23K, 23Y, 23M, and 23C; developing blades 24K, 24Y, 24M, and 24C, respectively; supplying rollers 25K, 25Y, 25M, and 25C that supply toners to the corresponding developing rollers 23K, 23Y, 23M, and 23C; cleaning blades 26K, 26Y, 26M, and 26C; and first toner-transporting paths 27K, 27Y, 27M, and 27C. The cleaning blades 26K, 26Y, 26M, and 26C and the first toner-transporting paths 27K, 27Y, 27M, and 27C constitute a cleaning means.

Figure 12:
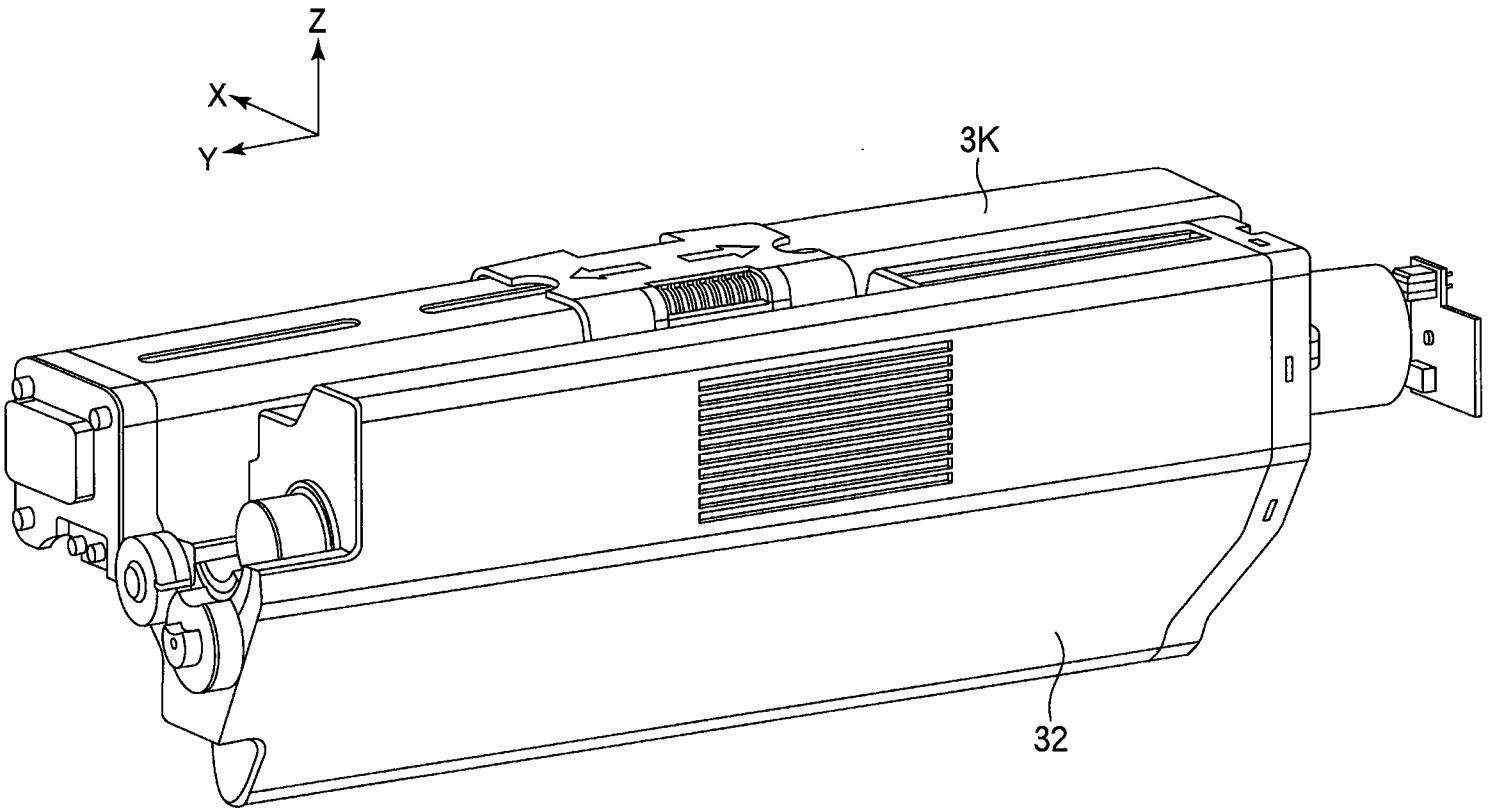
FIG. 12 illustrates a waste toner reservoir detachably attached to a black toner cartridge.

The first toner-transporting paths 27K, 27Y, 27M, and 27C transport waste toners, removed from the photoconductive bodies by the cleaning blades 26K, 26Y, 26M, and 26C, in a direction parallel to the rotational axes of the photoconductive bodies. The waste toners are then supplied to a second toner-transporting path 28. The second toner transporting path 28 is located at the basket 150, and transports the waste toners supplied from the first toner-transporting paths 27K, 27Y, 27M, and 27C to a waste toner reservoir 32 located at the most upstream of the developing units 2K, 2Y, 2M, and 2C aligned along the transport path of the paper. The waste toner reservoir 32 is detachably attached to the toner cartridge 3K (FIGS. 3 and 12), and holds the waste toners therein.

The developing apparatus 50 (FIG. 2), four toner cartridges 3, and the waste toner reservoir 32 are all replaceable units and can be replaced whenever toners are exhausted, structural elements are deteriorated, or the structural elements have reached the end of their lifetime.

Referring to FIG. 1, the X-axis represents the direction in which the paper passes through the developing units 2K, 2Y, 2M, and 2C. The Y-axis represents the rotational axis of the photoconductive bodies 21K, 21Y, 21M, and 21C. The Z-axis is an axis perpendicular to the X-axis and the Y-axis, and is substantially vertical. The X-axis, Y-axis, and Z-axis are commonly applied to all the figures in this specification.

Figure 3:
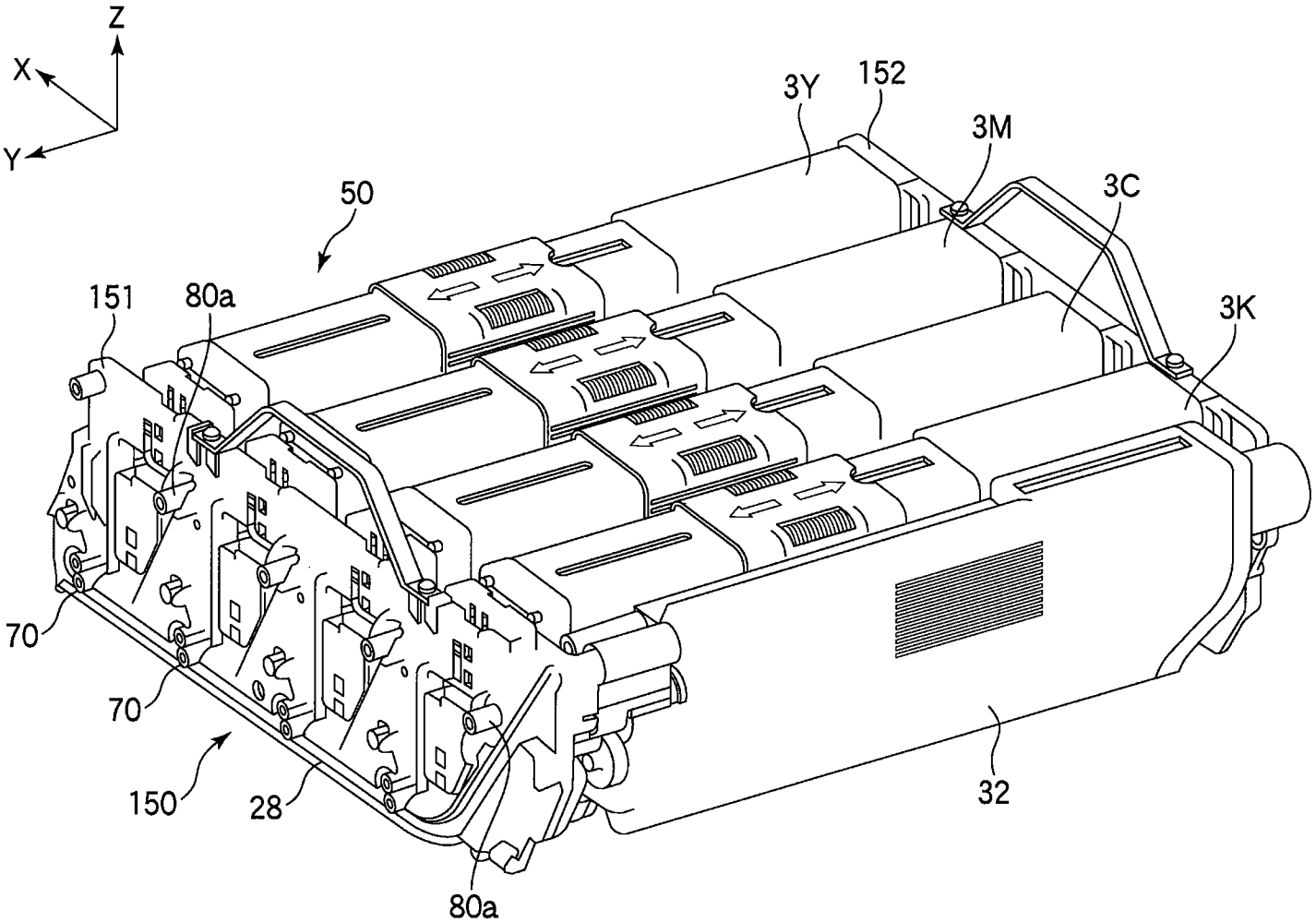
FIG. 3 illustrates toner cartridges attached onto corresponding developing units.

FIG. 2 is a perspective view of the developing apparatus 50 according to the embodiment. FIG. 3 illustrates the toner cartridges 3K, 3Y, 3M, and 3C detachably attached onto the corresponding developing units 2K, 2Y, 2M, and 2C from above. The developing apparatus 50 includes the developing units 2K, 2Y, 2M, and 2C aligned at equal intervals along the transport path of paper. The developing units 2K, 2Y, 2M, and 2C are movable by a predetermined distance relative to the basket 150. The developing apparatus 50 is detachably attached to the body of the image forming apparatus 1. The toner cartridges 3K, 3Y, 3M, and 3C supply toners to the corresponding developing units 2K, 2Y, 2M, and 2C.

The configuration of the developing units will now be described. The developing units 2K, 2Y, 2M, and 2C are substantially identical, and therefore the developing unit 2K will be described.

Figure 4:
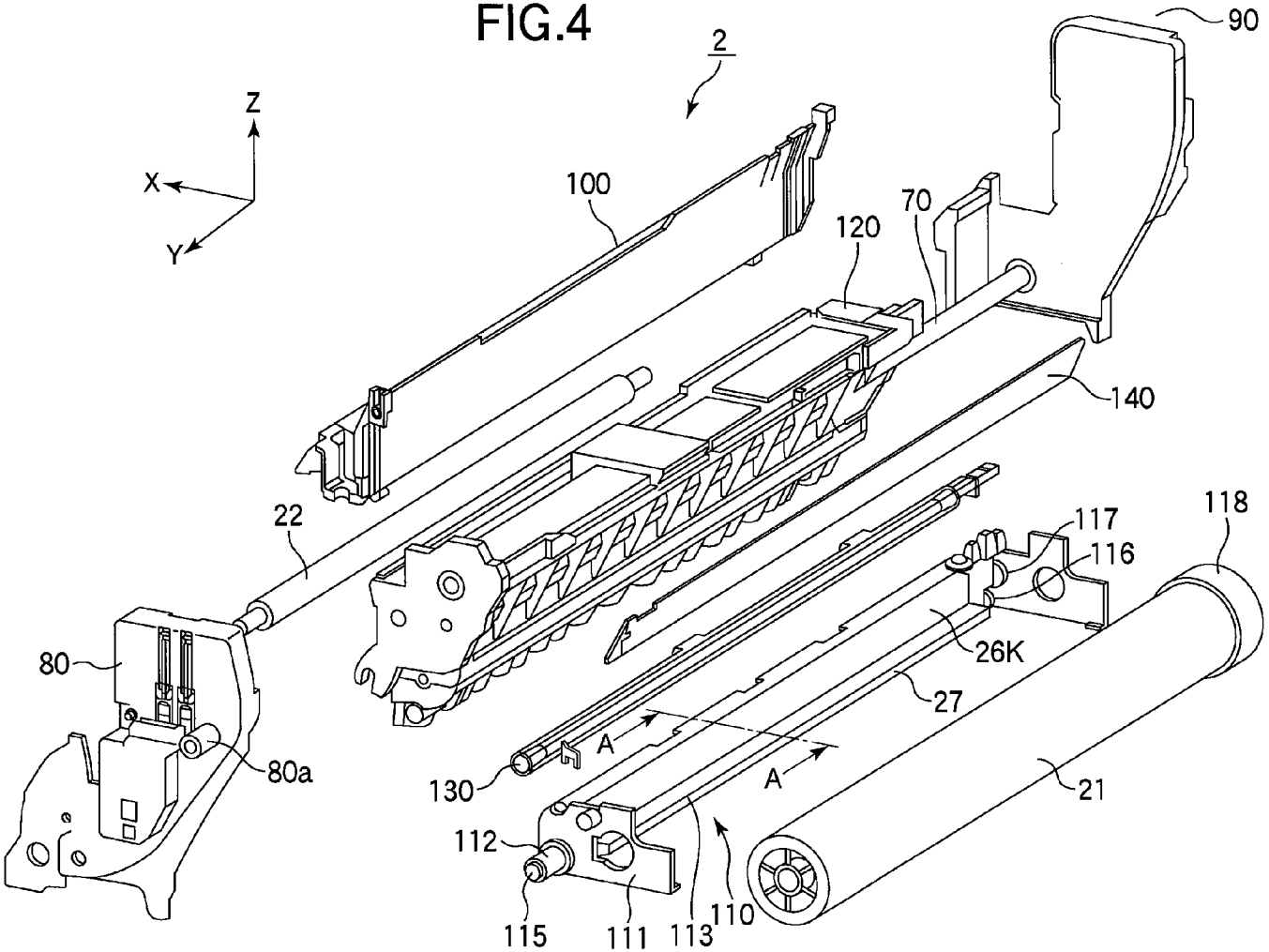
FIG. 4 illustrates an exploded perspective view of a developing unit.

FIG. 4 illustrates an exploded perspective view of the developing unit 2. The developing unit 2K includes the photoconductive body 21K, a charging roller 22K, a side plate L80, a side plate R90, upper frame 100, a base frame 110, a developing section 120 that serves, a neutralizing section 130, and a reinforcing plate 140. The base frame 110 extends in the direction of the Y-axis and parallels the photoconductive body 21K. The base frame 110 includes a base frame body 111, a cleaning blade 26K, a waste toner transporting port 112, a cleaning film 113, the first toner transporting path 27 and a first toner transporting auger 115, a drive gear 116, a connecting shaft 70 that extends to project from the both side plates, and an idle gear 117. The photoconductive body 21K is rotatably supported by the base frame 110 and the cleaning blade 26K contacts the circumferential surface of the photoconductive body 21K to scrape the toner remaining on the photoconductive body 21K into the first toner transporting path 27.

Figure 7:
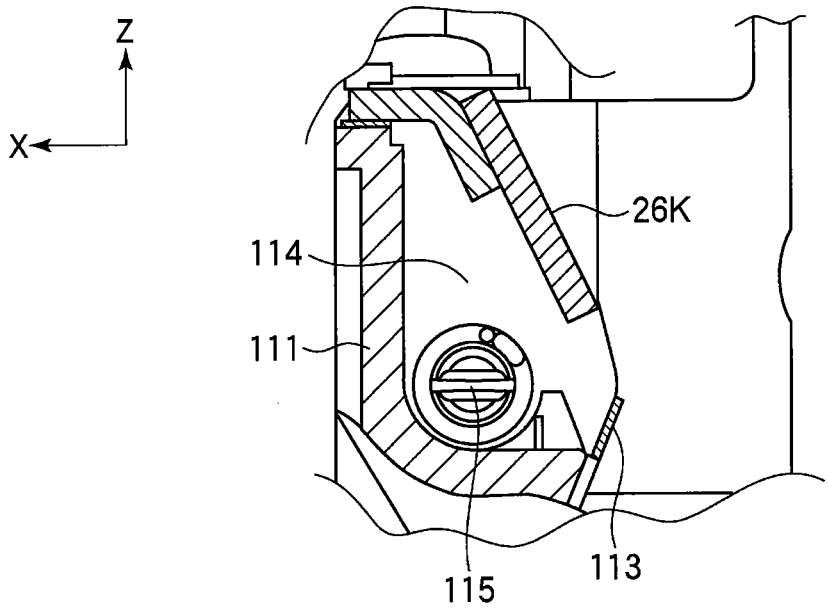
FIG. 7 is a cross-sectional view taken along a line A-A of FIG. 4.
Figure 8:
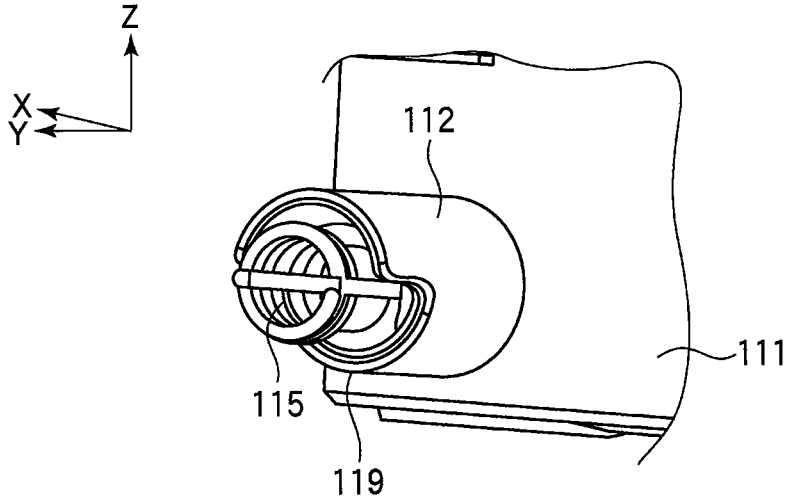
FIG. 8 is a partial enlarged perspective view of a waste toner transporting port.

FIG. 7 is a cross-sectional view taken along a line A-A of FIG. 4. The first toner transport path 27 is defined by the base frame body 111, the cleaning blade 26K, and the cleaning film 113, and extends in the direction of the Y-axis. FIG. 8 is a partial enlarged perspective view of the waste toner transporting port 112. The waste toner transporting port 112 is in the shape of a cylinder located at one end of the first toner transporting path 27, projecting from the base frame body 111. The first toner transporting auger 115 extends through the first toner transporting path 27 and the waste toner transporting port 112.

Referring to FIG. 4, one longitudinal end of the first toner transporting auger 115 extends outwardly from the waste toner transporting port 112, and another longitudinal end of the first toner transporting auger 115 is coupled to a drive gear 116, which in turn drives the first toner-transporting auger in rotation. The first toner transporting auger 115 is designed to transport the waste toner in the first toner transporting path 27 to the waste toner transporting portion 112 when the first toner transporting auger is driven in rotation. The idle gear 117 is driven in rotation by a drum gear 118 attached to one longitudinal end of the photoconductive body 21K. As shown in FIG. 8, the waste toner transporting port 112 is in the shape of a cylinder with an opening 119 formed in a lower portion thereof. The first toner transporting auger 115 projects somewhat further than the end of the waste toner transporting port 112, so that the waste toner arrived at the waste toner transporting port 112 falls through the opening into the waste toner transporting port 112.

The side plates 80 and 90 have projections 80*a* and 90*a* (only projection 80*a* is shown in FIG. 4), respectively. When the developing units 2K, 2Y, 2M, and 2C are mounted on the basket 150, the projections 80*a* and 90*a* loosely extend through elongate guide openings 151*a* and 152*a* (FIG. 5) formed in the basket 150, respectively. Thus, the projections 80*a* and 90*a* can loosely move in the elongate guide openings 151*a* and 152*a*.

The configuration of the basket 150 will be described in detail.

Figure 5:
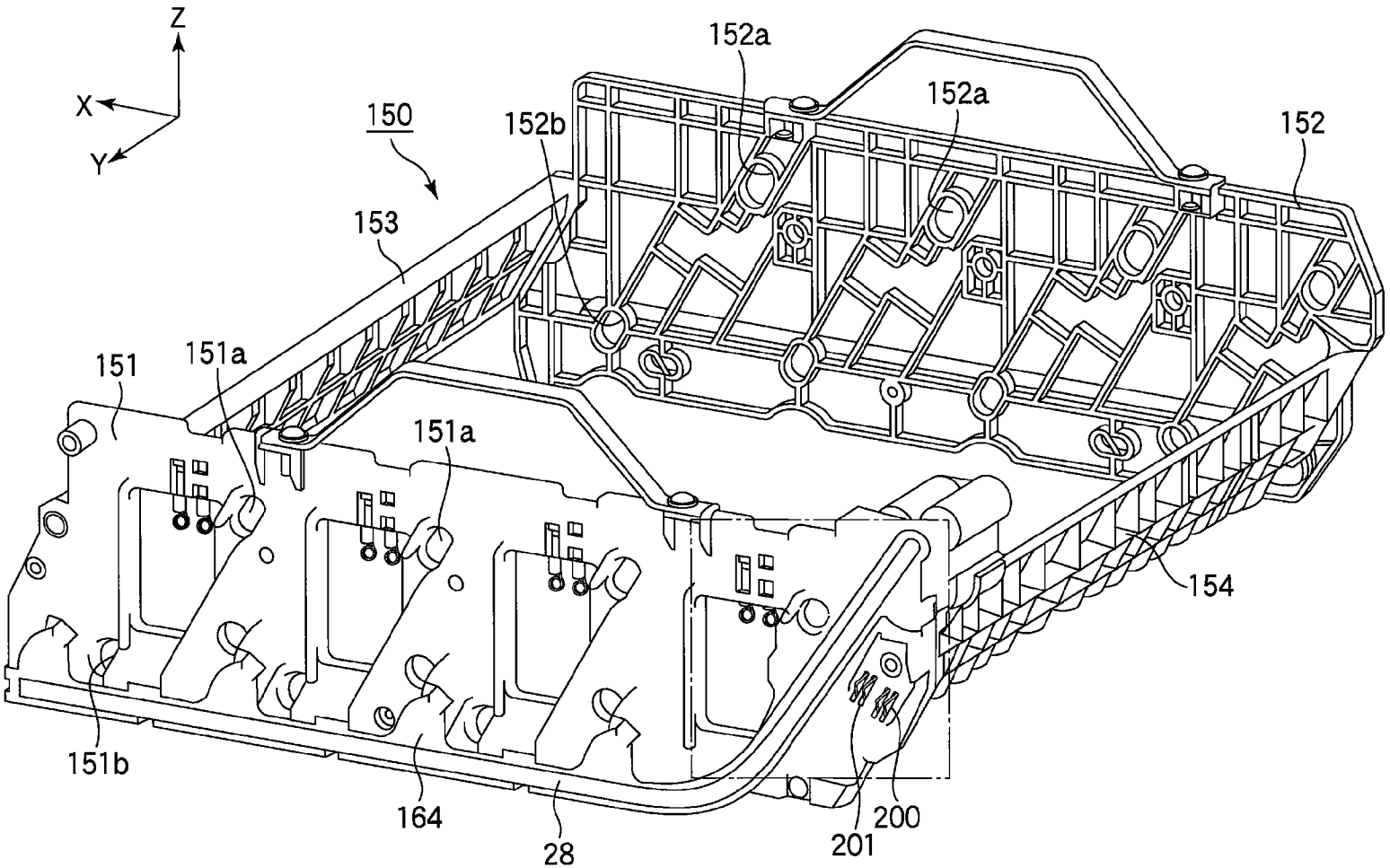
FIG. 5 is a perspective view of a basket or a frame as seen from above in an oblique direction.
Figure 6:
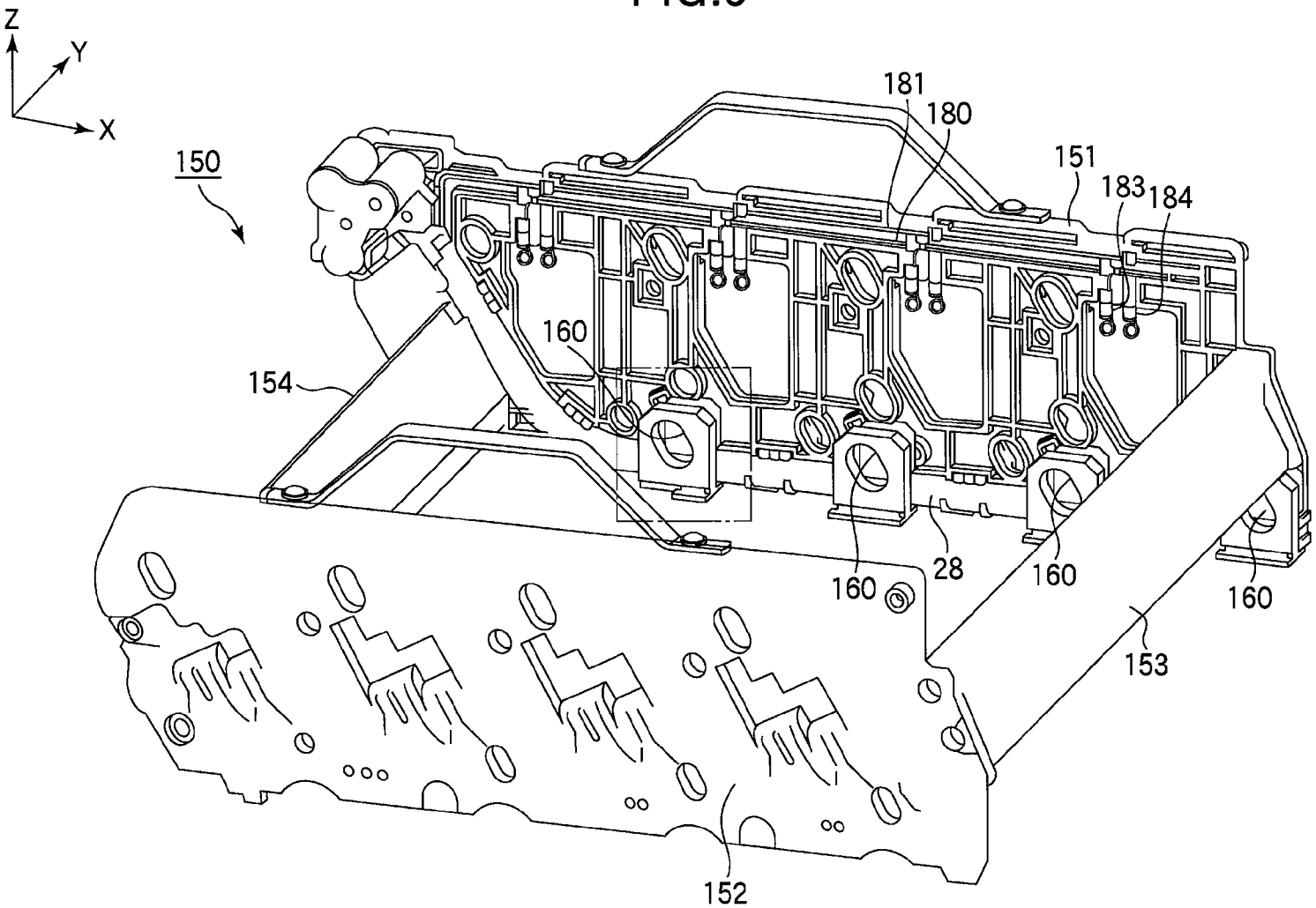
FIG. 6 is another perspective view of the basket as seen from above in an oblique direction opposite that shown in FIG. 5.

FIG. 5 is a perspective view of the basket 150 or a frame as seen from above in an oblique direction. FIG. 6 is another perspective view of the basket 150 as seen from above in an oblique direction opposite that shown in FIG. 5. The basket 150 includes a first side frame 151, a second side frame 152, a front frame 153, and a rear frame 154, which form a rectangular frame as a whole. The first frame 151 has elongate guide openings 151*a* and elongate guide openings 151*b*. The second side frame 152 has elongate guide openings 152*a* and elongate guide openings 152*b*. The elongate guide openings 151*a*, 152*a*, 151*b*, and 152*b* are formed at locations where the elongate guide openings 151*a*, 152*a* 151*b*, and 152*b* face the developing units 2K, 2Y, 2M, and 2C aligned in tandem when the developing units 2K, 2Y, 2M, and 2C have been attached to the basket 150, thereby receiving the four developing units 2K, 2Y, 2M, and 2C. The elongate guide openings extend at an angle with the Z-axis.

The projection 80*a* of the side plate 80 (FIG. 4) enters the elongate guide opening 151*a* and the projection 90*a* of the side plate 90 (not shown) enters the elongate guide opening 152*a*. The side plates 80 and 90 each have a connecting shaft 70 (FIGS. 2 and 4) projecting therefrom. The connecting shaft 70 extends through the elongate guide opening 151*b* formed in the first side frame 151 and the elongate guide opening 152*b* formed in the second side frame 152.

Thus, the developing units 2K, 2Y, 2M, and 2C are supported by the basket 150 so that the developing units 2K, 2Y, 2M, and 2C are guided by the elongate guide openings 151*a*, 152*a*, 151*b*, and 152*b* to move by a distance L1 (FIG. 10) in an oblique direction. This configuration allows the developing units 2K, 2Y, 2M, and 2C to move effectively vertically relative to the transfer unit 4 between a non-idle position where the photoconductive body 21 contacts the transfer unit 4 and an idle position where the photoconductive body 21 does not contact the transfer unit 4. For example, when the developing units 2K, 2Y, 2M, and 2C are not to operate, the developing units 2K, 2Y, 2M, and 2C may be placed at the idle position, thereby prolonging their usable lifetime.

It is to be noted that only the developing unit 2K is configured not to move vertically and therefore the projections 80*a* and 90*a* extend through substantially round openings instead of elongate guide openings.

Figure 9:
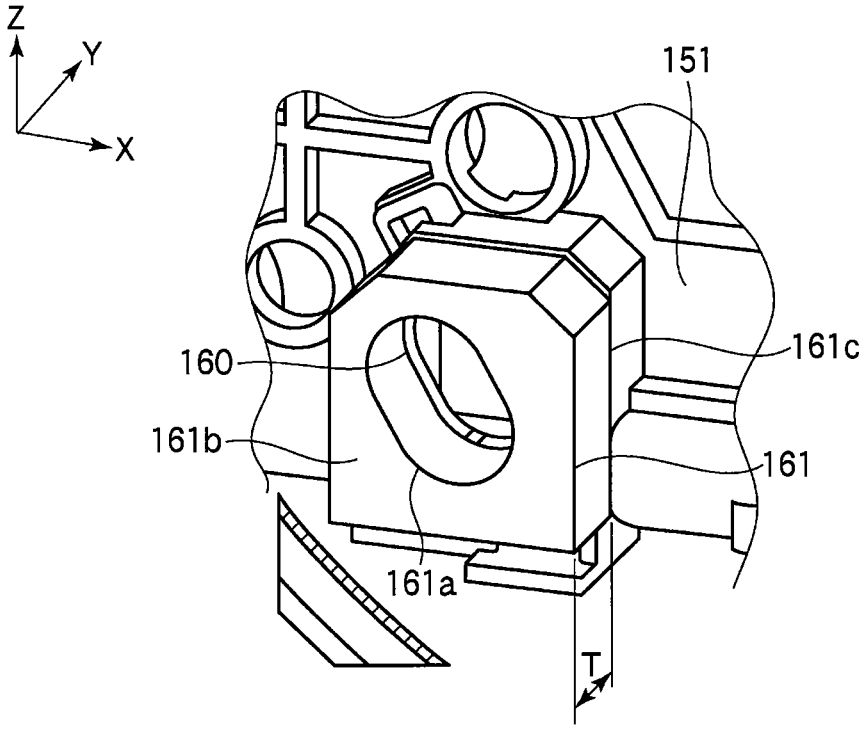
FIG. 9 is a partial elongated view of the vicinity of a waste toner receiving port enclosed by dot-dot-dash lines in FIG. 6.
Figure 10:
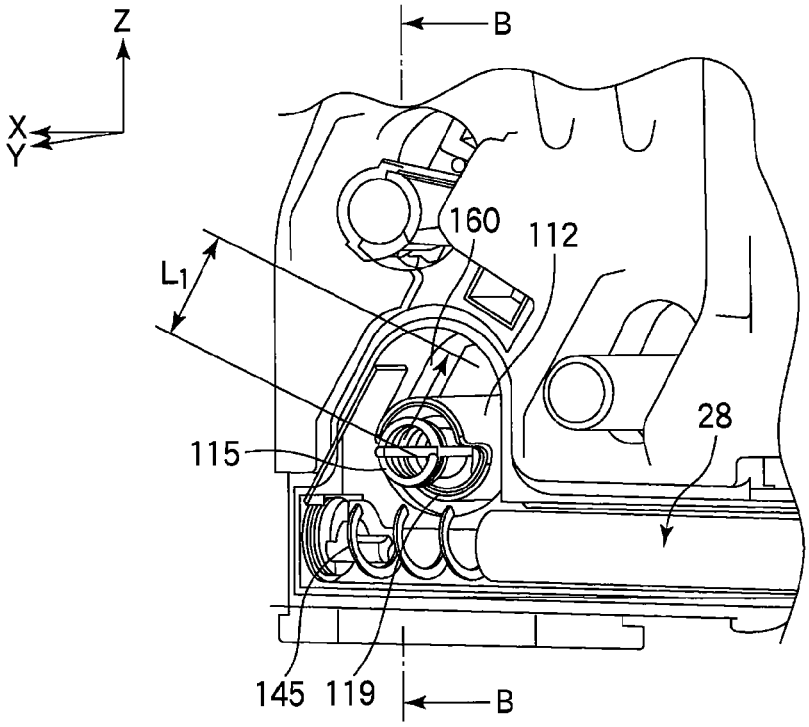
FIG. 10 is a perspective view of a waste toner transporting opening when the developing unit is at a non-idle position, as seen from the side of a first side frame of the basket opposite that shown in FIG. 9.
Figure 11:
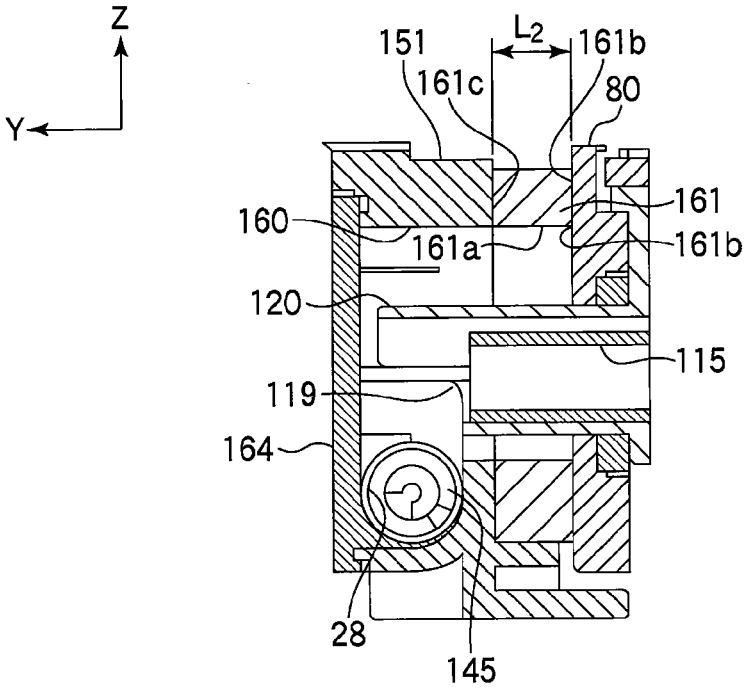
FIG. 11 is a cross-sectional view taken along a line B-B shown in FIG. 10 when a cover wall has been attached to the first side frame.

FIG. 9 is a partial enlarged view of the vicinity of a waste toner receiving port 160 enclosed by dot-dot-dash lines in FIG. 6. FIG. 10 is a perspective view of the waste toner transporting opening 112 (FIG. 4) when the developing units 2K, 2Y, 2M, and 2C are at the non-idle position, as seen from the side of the first side frame 151 opposite that shown in FIG. 9. FIG. 11 is a cross-sectional view taken along a line B-B shown in FIG. 10 when a cover wall 164 (FIG. 5) has been attached.

The first side frame 151 has the waste toner receiving ports 160. Once the developing units 2K, 2Y, 2M, and 2C have been attached to the basket 150, the waste toner receiving ports 160 face the waste toner transporting ports 112 (FIG. 4). The respective waste toner receiving ports 160 communicate with the second transport path 28 located at a lower portion of the first side frame 151. The second transport path 28 extends in the X-axis (FIG. 2), and communicates with the waste toner transports 112 of the four developing units 2K, 2Y, 2M, and 2C. The second toner transporting path 28 ha-s a second transporting auger 145 therein that transports the waste toner that falls from the respective waste toner transporting ports 112 of the respective developing units 2K, 2Y, 2M, and 2C to the waste toner reservoir 32. The second toner transporting path 28 is covered with the cover wall 164 as shown in FIGS. 5 and 11.

The waste toner receiving ports 160 have an elongate opening extending in directions parallel to the elongate guide openings 151*a* and 151*b* so that the developing units 2K, 2Y, 2M, and 2C can move along the elongate guide openings 151*a* and 151*b* with the waste toner transporting port 112 received in the waste toner receiving ports 160. The elongate opening 161*a* allows the waste toner transporting port 112 to move by a distance L1 (FIG. 10) as the developing unit 2Y moves.

As is clear from FIG. 11, there is a gap L2 between the side plate 80 of the developing unit 2 and the first side frame 151 of the basket 150 once the developing unit 2 has been attached to the basket 150. A sealing member 161 is inserted in the gap L2, thereby preventing the waste toner, discharged through the waste toner transporting port 112 inserted into the elongate waste toner receiving port 160, from leaking into the basket 150. The sealing member 161 is formed of an elastic material such as sponge or rubber. The sealing member 161 has a thickness T larger than the gap L2 and an elongate opening 161*a* as shown in FIG. 9. The elongate opening 161*a* and the opening formed in the elongate waste toner receiving port 160 are identical in shape and size but one is a mirror image of the other. One side surface 161*c* of the sealing member 161 is bonded to the first side frame 151 by means of a tape of the double-stick type and the other side surface 161*b* is pressed against the side plate 80.

The sealing member 161 is formed of an elastic, deformable material such as sponge or rubber, so that when the developing unit moves within the distance L1, the sealing member 161 is not an obstacle. The thickness T, distance L1, and gap L2 are related as follows:

$$T \geq L1 + L2 \quad (1)$$

This relation is effective in preventing the waste toner from leaking since there is no gap between the side plate 80 and the side surface 161*b* of the sealing member 161 when the developing unit moves. Therefore, the developing unit is allowed to move while the side surface 161*b* remaining in intimate contact with a fixed position on the side plate 80.

In addition, the sealing member 161, which has the thickness T when it is in a relaxed state, is disposed in the gap L2 so that the sealing member 161 is in intimate contact with the side plate 80 and the developing unit is urged toward the second side frame 152. In other words, the developing unit is prevented from rattling.

As described above, once the developing apparatus 50 has been attached to the image forming apparatus 1, the sealing member 161 elastically seals the gap L2 between the waste toner transporting port 112 (end portion of the first toner transporting path 27) of the developing unit 2Y and the second toner transporting path 28 of the basket 150. In other words, the basket 150 and the developing unit 2Y are coupled by means of the elastic, deformable sealing member 161, so that the developing unit 2Y is movable by a small certain distance relative to the basket 150.

The above described configuration permits the developing units to move vertically between the non-idle position where the photoconductive body 21 contacts the transfer unit 4 and the idle position where the photoconductive body 21 does not contact the transfer unit 4. This substantially vertical movement of the developing units will now be described.

Figure 13:
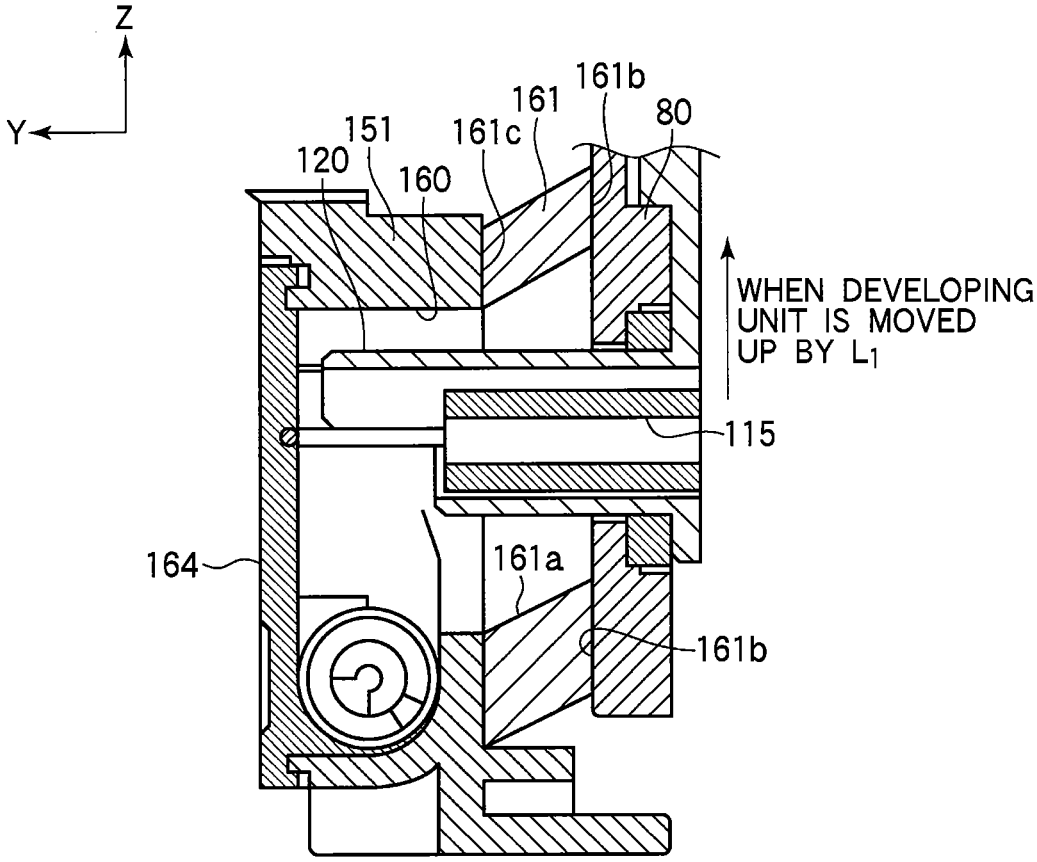
FIG. 13 illustrates the vicinity of a waste toner transporting port when a transfer unit is at an idle position.

FIG. 13 illustrates the vicinity of the waste toner transporting port 112 when the transfer unit 4 is at the idle position. FIG. 11 illustrates the vicinity of the waste toner transporting port 112 when the transfer unit 4 is at the non-idle position.

When the transfer unit 4 is at the non-idle position shown in FIG. 11 and normal printing begins, the photoconductive body 21 rotates together with a transport idle gear 117, a transport drive gear 116, and the first transport auger 115, so that the waste toner is transported to the waste toner transporting port 112 and falls through the opening 119 into the waste toner receiving port 160 (FIG. 10). The sealing member 161 effectively prevents the waste toner from leaking through the waste toner transporting port 112 and the waste toner receiving port 160 into the basket 150.

Because the sealing member 161 has a thickness of T given by Inequality (1) and has the side surface 161*c* bonded to the first side frame 151 by means of the tape of double-stick type and the side surface 161*b* intimately pressed against the side plate 80. When the photoconductive body 21 moves toward the idle position, the photoconductive body 21 moves with one surface of the sealing member 161 whose another surface is maintained in intimate contact with the developing unit, so that the surface 161*b* follows the movement of the developing unit without slipping. Thus, when the developing unit is moving or is at the idle position, the waste toner will not leak through the transporting port 112 and the waste toner receiving port into the basket 150.

In addition, the configuration maintains the urging force acting on the developing unit 2Y toward the second side frame 152 opposite the first side frame 151, preventing the developing units from rattling when the developing unit 2Y is moving or is at the idle position.

If the thickness T of the sealing member 161 is too small to satisfy the relation of Inequality (1), the side surface 161*b* is pressed against the side plate 80 by less force. Therefore if the developing unit 2Y moves to the idle position, the sealing member 161 is not sufficiently compressed or not in the compressed state causing the surface 161*b* not to follow the movement of the developing unit without slipping. As a result, the side surface 161*b* may slip on the side plate 80 causing the waste toner to leak through the gap between the side surface 161*b* and the side plate 80. If the sealing member 161 is too hard, the side surface 161*b* cannot follow the movement of the side plate 80, and may slip causing the waste toner to be apt to leak.

As described above, when the developing unit moves relative to the basket 150 between the non-idle position as the idle position, the waste toner is still transported without leakage. The sealing member 161 substantially seals the gap between the first toner transporting paths 27 of the developing units and the second toner transporting paths 28 of the basket 150. Thus, the waste toner is prevented from leaking and the developing unit 2Y is prevented from rattling relative to the basket 150.

Figure 14:
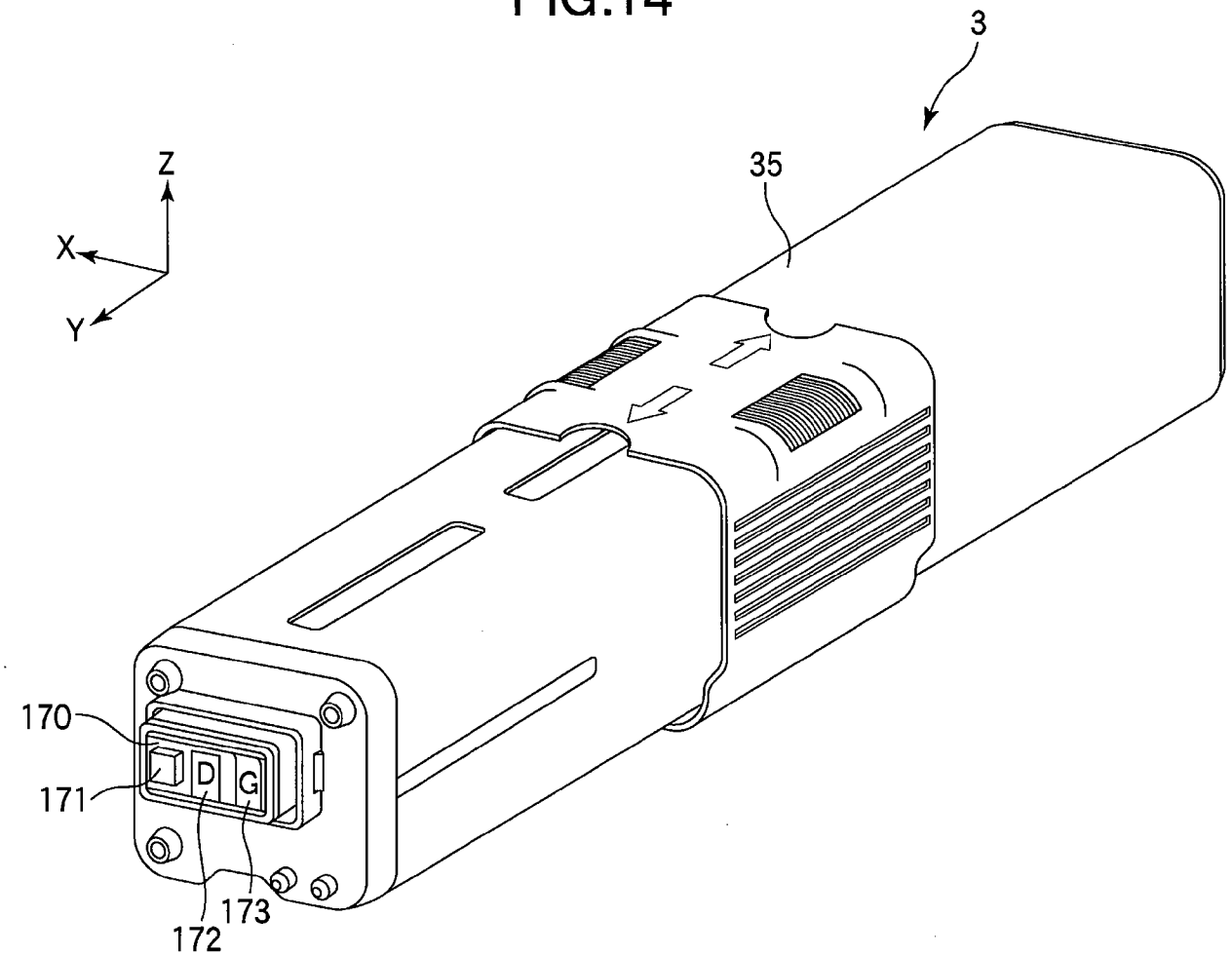
FIG. 14 is a perspective view of the toner cartridge.

FIG. 14 is a perspective view of the toner cartridge 3.

A memory circuit board 170 is located at a longitudinal end of the toner cartridge 3, and carries contacts points 172 and 173 and a memory element 171 thereon.

Figure 15:
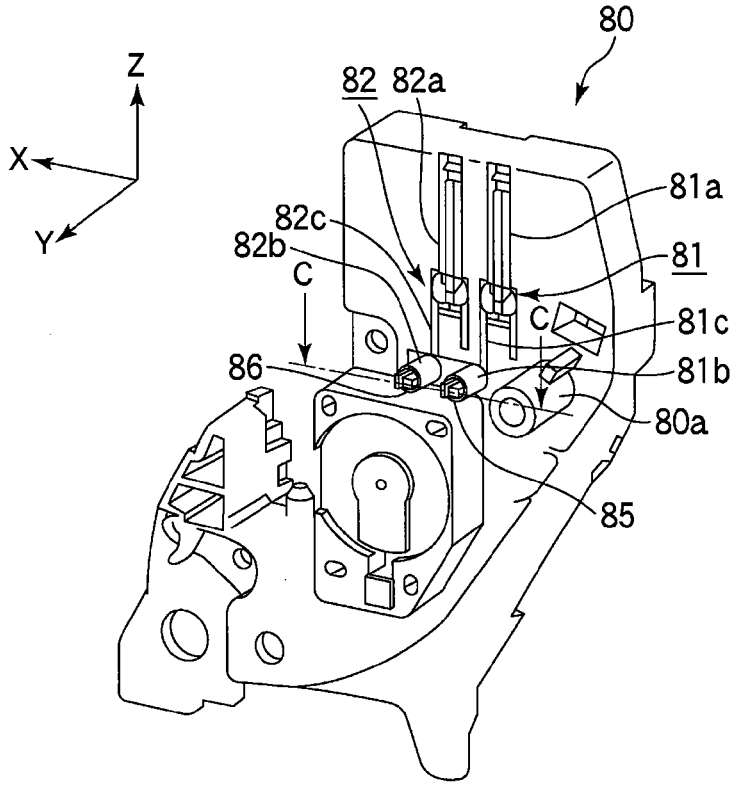
FIG. 15 is a perspective view of a side plate of the developing unit.
Figure 16:
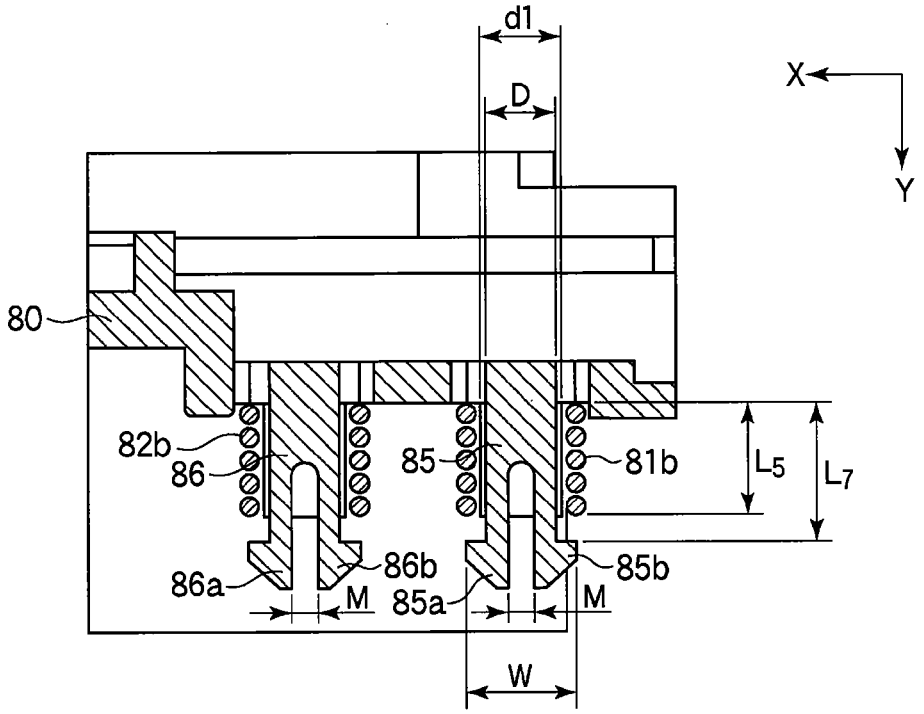
FIG. 16 is a cross-sectional view taken along a line C-C of FIG. 15.

FIG. 15 is a perspective view of the side plate 80 and FIG. 16 is a cross-sectional view taken along a line C-C of FIG. 15.

The side plate 80 has contact springs 81 and 82 or second conductive members located on the inner wall of the side plate 80. The contact springs 81 includes a compressed coil spring 81*b* and an end 81*a* electrically connected to the compressed coil spring 81*b*. The contact spring 82 includes a compressed coil spring 82*b* and an end 82*a* electrically connected to the compressed coil spring 82*b*. When the toner cartridge 3 has been attached to the developing unit, the ends 81*a* and 82*a* of the contact springs 81 and 82 contact contacts 172 and 173, respectively, under a predetermined pressure. The ends 81*a* and 82*a* and contacts 172 and 173 are gold plated.

The contact springs 81 and 82 or first conductive members have electrical contacts 81*c* and 82*c* connected to compressed coil springs 81*b* and 82*b*, respectively. The compressed coil springs 81*b* and 82*b* fit over the coil spring posts 85 and 86, respectively. As shown in FIG. 16, the coil spring post 85 has a pair of hooks 85*a* and 85*b*. The hooks 85*a* and 85*b* are identical in shape and size and are spaced apart by a predetermined distance M and one hook is a mirror image of the other hook. The hooks 85*a* and 85*b* cooperate with each other to form a generally tapered conical outer surface. The coil spring post 86 has a pair of hooks 86*a* and 86*b*. The hooks 86*a* and 86*b* are identical in shape and size and are spaced apart by a predetermined distance M and one hook is a mirror image of the other hook. The hooks 86*a* and 86*b* cooperate with each other to form a generally tapered conical outer surface.

Figure 17A:
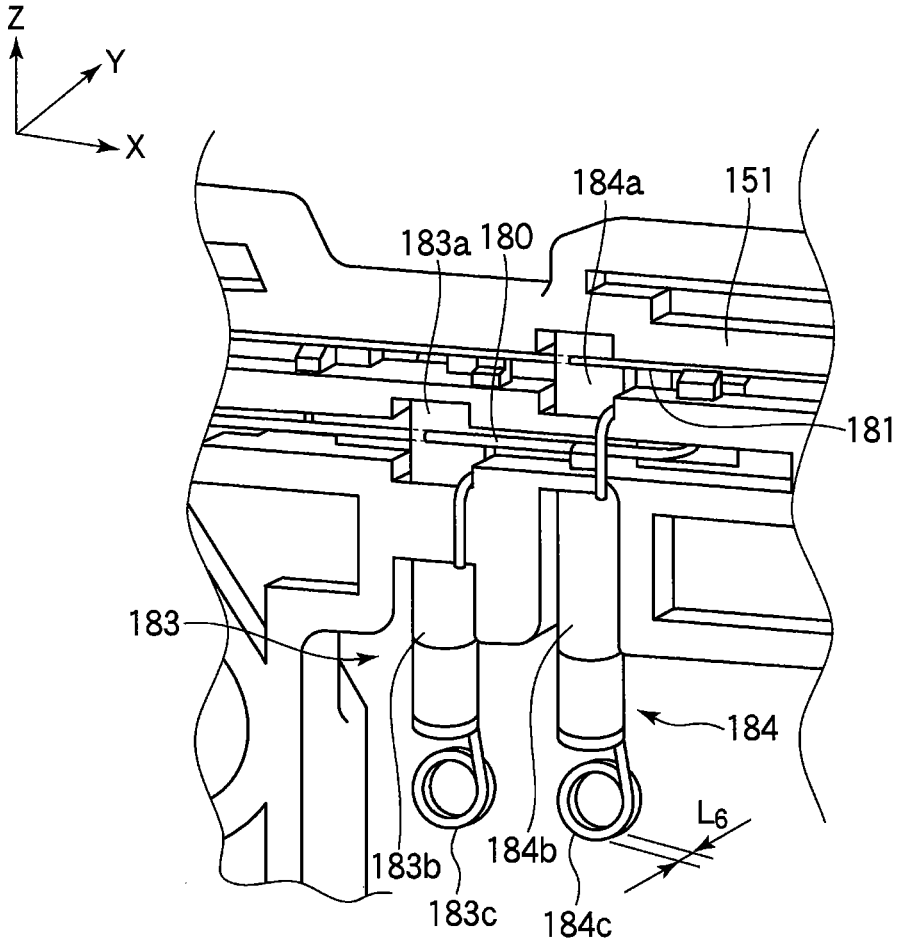
FIG. 17A is an enlarged view of urging springs located on the inner wall of the first side frame of the basket shown in FIG. 6.

FIG. 17A is an enlarged view of the urging springs 183 and 184 located on the inner wall of the first side frame 151 of the basket 150 shown in FIG. 6.

Figure 17C:
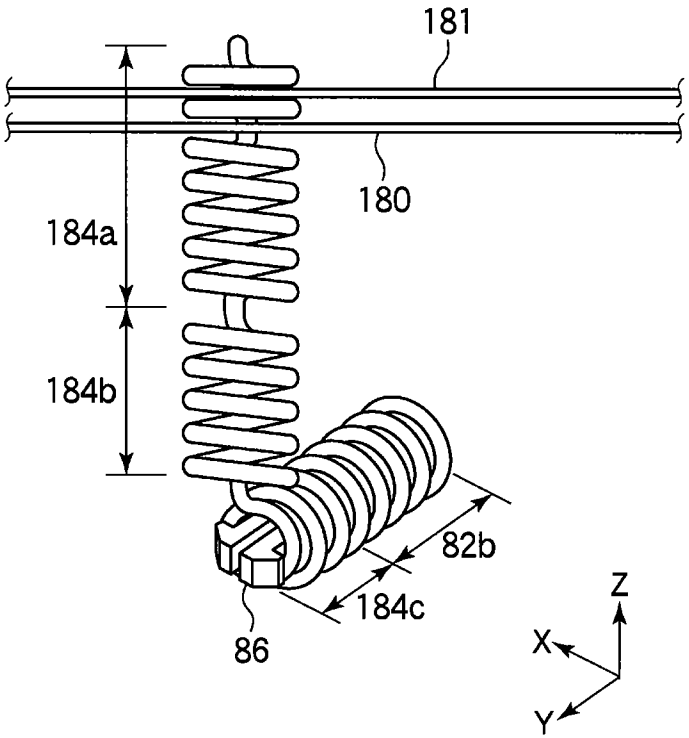
FIG. 17C illustrates another urging spring and another compressed coil spring.
Figure 17B:
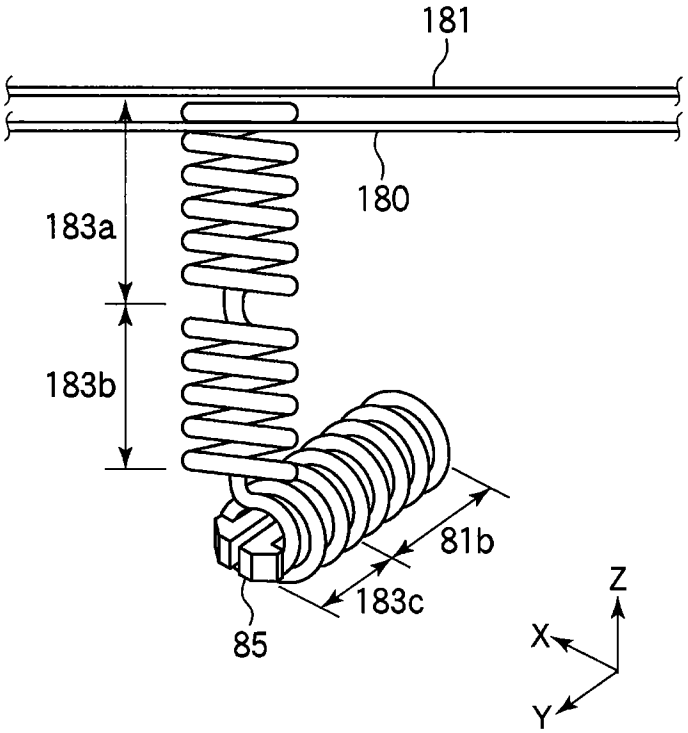
FIG. 17B illustrates one urging spring and one compressed coil spring.

FIG. 17B illustrates the urging spring 183 and the compressed coil spring 81.

FIG. 17C illustrates the urging spring 184 and the compressed coil spring 82.

Figure 18:
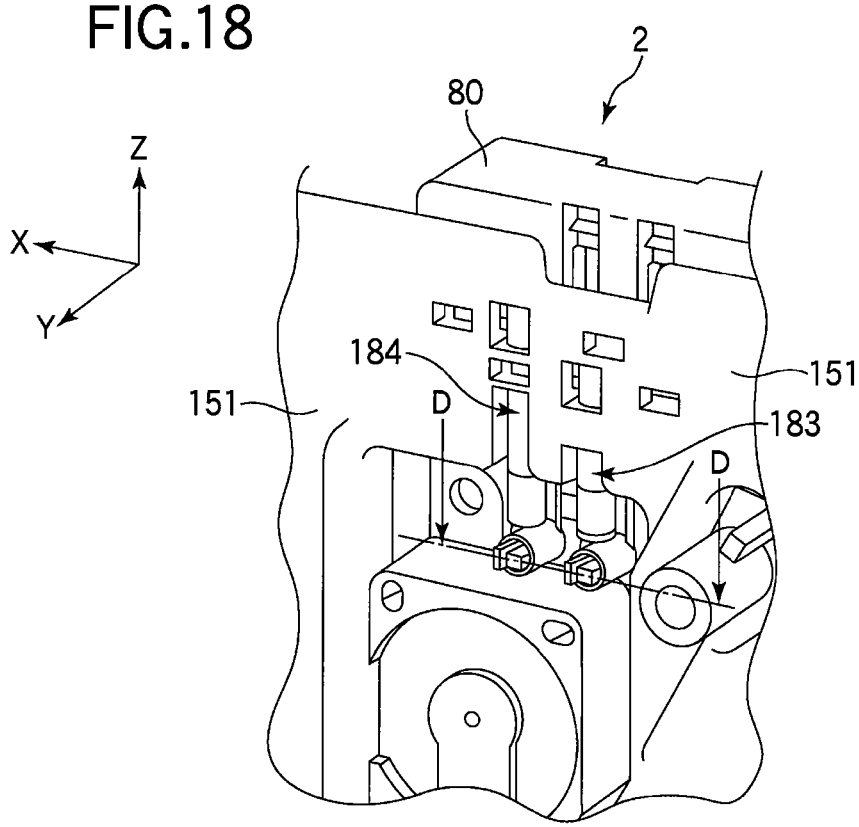
FIG. 18 is a partial enlarged view illustrating a portion enclosed by dot-dot-dash lines in FIG. 2.

FIG. 18 is a partial enlarged view illustrating a portion enclosed by dot-dot-dash lines in FIG. 2, with a cover plate 190 omitted.

Figure 19:
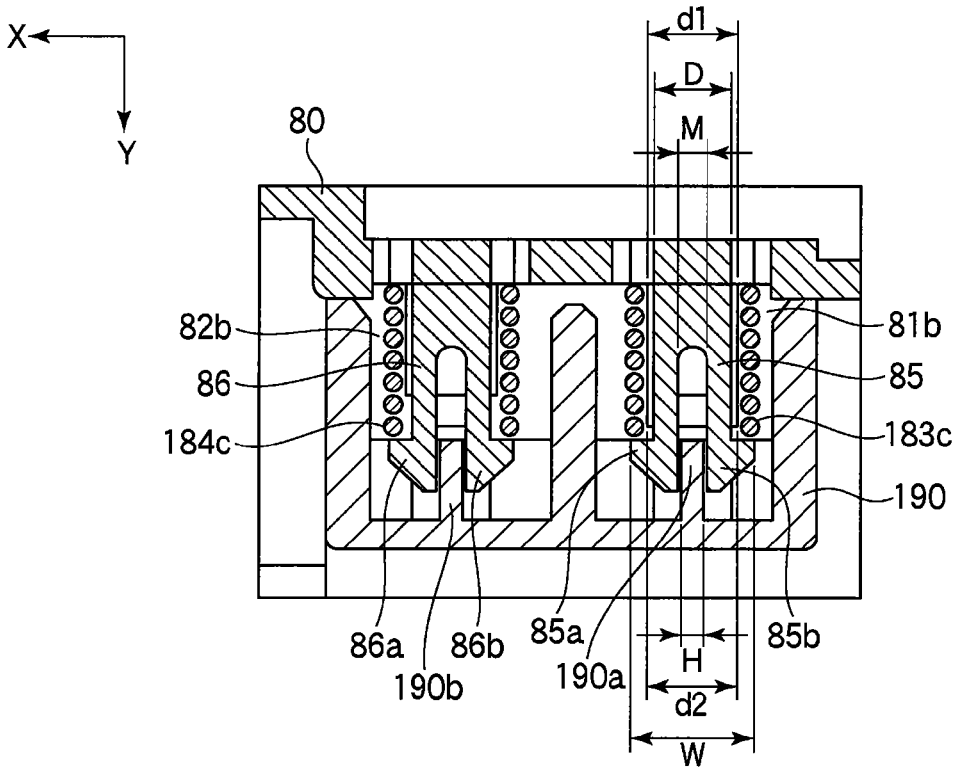
FIG. 19 is a cross-sectional view taken along a line D-D of FIG. 18.

FIG. 19 is a cross-sectional view taken along a line D-D of FIG. 18, the cover plate 190 being attached.

Figure 20:
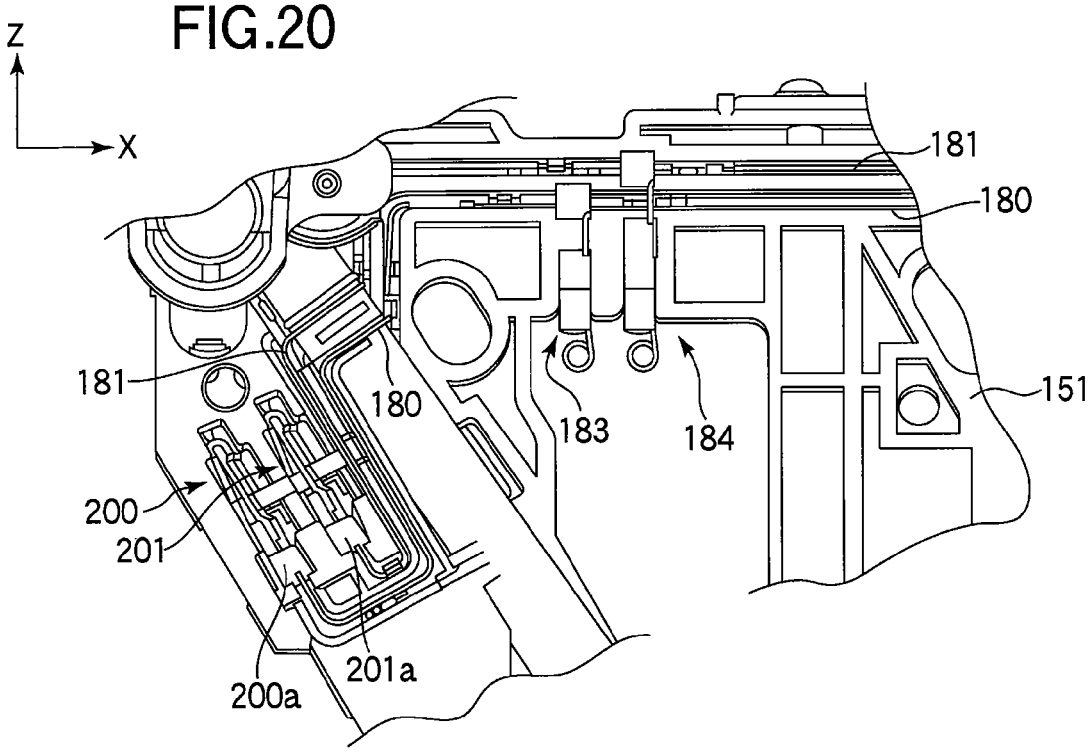
FIG. 20 is a view illustrating the contact springs and their vicinity as seen from inside of the basket.

FIG. 20 is a view illustrating the contact springs 200 and 201 and their vicinity as seen from inside of the basket 150.

Figure 21:
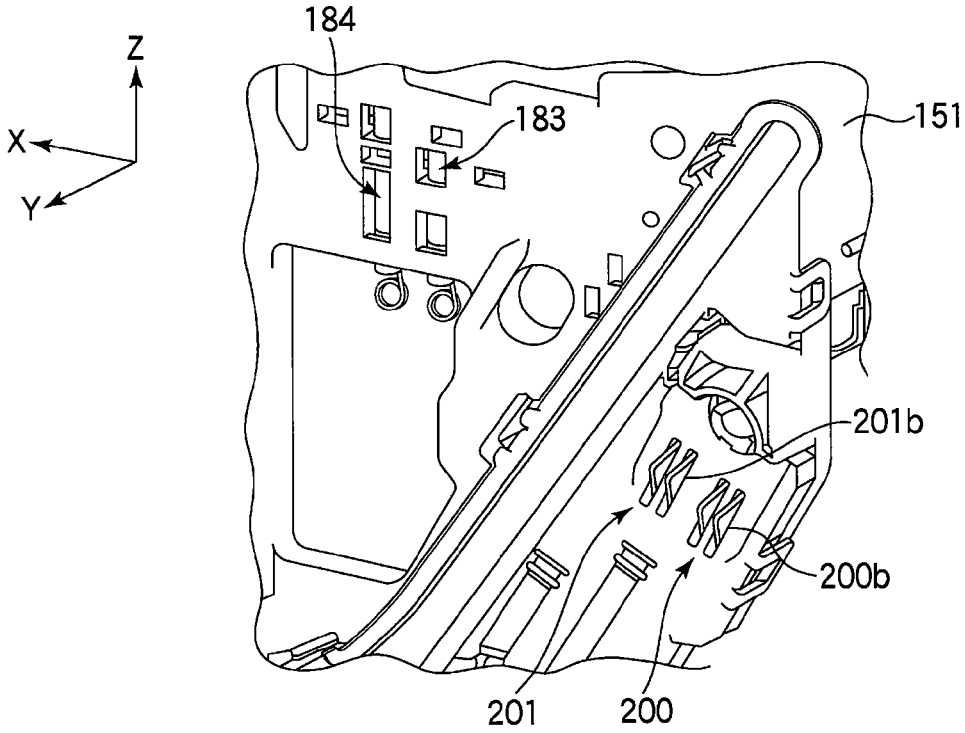
FIG. 21 is a partial perspective view of the vicinity of the contact springs as seen from the side opposite that shown in FIG. 20.

FIG. 21 is a partial perspective view of the vicinity of the contact springs 200 and 201 as seen from the side opposite that shown in FIG. 20, and illustrating a portion of the contact springs 200 and 201 enclosed by dot-dot-dash lines in FIG. 5.

The urging springs 183 and 184 are located at a location shown in FIG. 6 such that when the developing unit is attached to the basket 150, the third portions 183*c* and 184*c* of urging springs 183 and 184 directly face the coil spring posts 85 and 86, respectively.

Referring to FIGS. 173 and 17C, electrically conductive wires 180 and 181 or second conductive members are located on an upper portion of the inner surface of the first side frame 151 and extend in the direction of the X-axis. The electrically conductive wires 180 and 181 are firmly sandwiched between adjacent turns of the urging sprigs 183 and 184 of the respective developing units 2, so that the electrically conductive wires 180 and 181 are electrically connected to the urging springs 183 and 184. The electrically conductive wires 180 and 181 are also electrically connected to the respective coil springs 200*a* and 201*a* (FIG. 20) of the contact springs 200 and 201 (FIG. 21).

Referring to FIG. 17, the urging spring 183 at each of the respective developing units 2K, 2Y, 2M, and 2C includes a first portion 183*a*, a second portion 183*b*, and the third portion 183*c*. The coil spring 184 at each of the respective developing units 2K, 2Y, 2M, and 2C includes a first portion 184*a*, a second portion 184*b*, and the third portion. The first portions 183*a* and 184*a* of the urging springs 183 and 184 are compressed at different compression level in a direction perpendicular to the direction in which the electrically conductive wires 180 and 181 extend. When the first portions 183*a* and 184*a* are mounted to the first side frame 151, they are compressed to hold the electrically conductive wires 180 and 181 in a sandwiched relation. The second portions 183*b* and 184*b* are be compressed in directions in which the developing unit 2 moves up and down along the elongate guide openings 151*a* and 152*a*. The relaxed length of the second portions 183*b* and 184*b* are given as follows:

$$L3 \geq L4 + L1 \quad (2)$$

where L1 is a distance over which the developing unit can move along the elongate guide openings, L4 is the length of the second compressed coil spring when fully compressed, and L3 is the length of the second compressed coil spring when the second coil spring is relaxed.

The third portions 183*c* and 184*c* may be compressed in directions in which the coil spring posts 85 and 86 extend. The third portions 183*c* and 184*c* and compressed coil springs 81*b* and 82*b* are related as follows:

$$L5 + L6 \geq L7 \geq L8 + L9 \quad (3)$$

where L5 (FIG. 16) is the length of the compressed coil springs 81*b* and 82*b* of the contact springs 81 and 82 when they are relaxed, L6 is the length of the third portions 183*c* and 184*c* when they are relaxed, L7 is an effective length (FIG. 16) of the coil spring posts 85 and 86, L8 is the length of the third portions 183*c* and 184*c* when they are fully compressed.

As shown in FIGS. 18 and 19, the third portions 183*c* and 184*c* fit over the coil spring posts 85 and 86 together with the compressed coil springs 81*b* and 82*b* of the contact springs 81 and 82. The cover plate 190 is attached to the basket 150 to hold the third portions 183*c* and 184*c* and the compressed coil springs 81*b* and 82*b* in urging engagement with each other.

Satisfying inequality (3), the third portion 183*c* and the compressed coil spring 81*b* are in pressing engagement or urging engagement with each other, establishing an electrical path, and the third portion 184*c* and the compressed coil spring 82*b* are in pressing engagement or urging engagement with each other establishing an electrical path. Satisfying inequality (2), the projection 80*a* of the developing unit 2Y may be urged by the urging spring 183 and 184 against the bottom wall of the elongate guide opening 151*a* (FIG. 5), thereby preventing rattling of the developing unit 2Y to hold the developing unit 2 in position.

As shown in FIG. 19, the cover plate 190 includes ribs 190*a* and 190*b* at an inner bottom wall thereof. When the cover 190 is attached to the basket 150, the ribs 190*a* and 190*b* enter a gap M between the hooks 85*a* and 85*b* and a gap between the hooks 86*a* and 86*b*, respectively. The following relations are satisfied between the coil spring posts 85 and 86, hooks 85*a* and 85*b*, cover plate 190, contact springs 81 and 82, compressed coil springs 81*b* and 82*b*, and third portions 183*c* and 184*c*.

$$d1 \geq D,\ d2 \geq D,\ W - M + H \geq d1, \text{ and } W - M + H \geq d2$$

where D is the width of the coil spring posts 85, M is the gap between the hooks 85*a* and 85*b*, H is the width of the ribs 190*a* of the cover plate 190, W is the distance between outer ends of hooks 85*a* and 85*b*, d1 is the inner diameter of the compressed coil springs 81*b*, and d2 is the inner diameter of the third portions 183*c*.

These relations prevent the coil springs 81*b* and 183*c* from dropping off the coil spring post 85 once the cover plate 190 has been attached to the basket 150 after the compressed coil spring 81*b* and the third portion 183*c* are fitted over the coil spring post 85. Likewise, these relations prevent the coil springs 82*b* and 184*c* from dropping off the coil spring post 86 once the cover plate 190 has been attached to the basket 150 after the compressed coil spring 82*b* and the third portions 184*c* are fitted over the coil spring posts 86.

Referring to FIGS. 20 and 21, the contact spring 200 includes a coil spring 200*a* and a contact 200*b*, and the contact spring 201 includes a coil spring 201*a* and a contact 201*b*. When the contact springs 200 and 201 are mounted to the first side frame 151, conductive wires 180 and 181 are pushed into adjacent turns of the contact springs 200 and 201 so that the conductive wires 180 and 181 are firmly sandwiched between adjacent turns of the contact springs 200 and 201, respectively. Thus, the contact springs 200 and 201 are electrically continuous to the conductive wires 180 and 181, respectively. The contacts 200*b* and 201*b* project outwardly from the first side frame 151 through openings formed in the first side frame 151 as shown in FIG. 21. When the developing apparatus 50 (FIG. 2) has been attached to the image forming apparatus 1, the contacts 200*b* and 201*b* are in contact engagement with contacts (not shown) on the image forming apparatus side, thereby making electrical connection therebetween. The contacts 200*b* and 201*b* and the vicinity in contact with the contacts 200*b* and 201*b* are gold-plated.

As described above, when the developing apparatus 50 is attached into the image forming apparatus 1, the respective developing units 2K, 2Y, 2M, and 2C are resiliently supported on the side frame 151 of the basket 150 by means of the urging springs 183 and 184. The urging springs 183 and 184 have the third portions 183*c* and 184*c*, which in turn are electrically continuous to the compressed coil springs 81*b* and 82*b*, respectively. The urging springs 183 and 184 also have the second portions 183*b* and 184*b* that contribute to support the developing unit 2Y resiliently so that the developing unit 2Y can move along the elongate guide openings 152*a* and 152*b*.

A description will be given of the operation of the developing unit 2 in which the developing unit 2 moves up and down between the non-idle position and the idle position.

Figure 22:
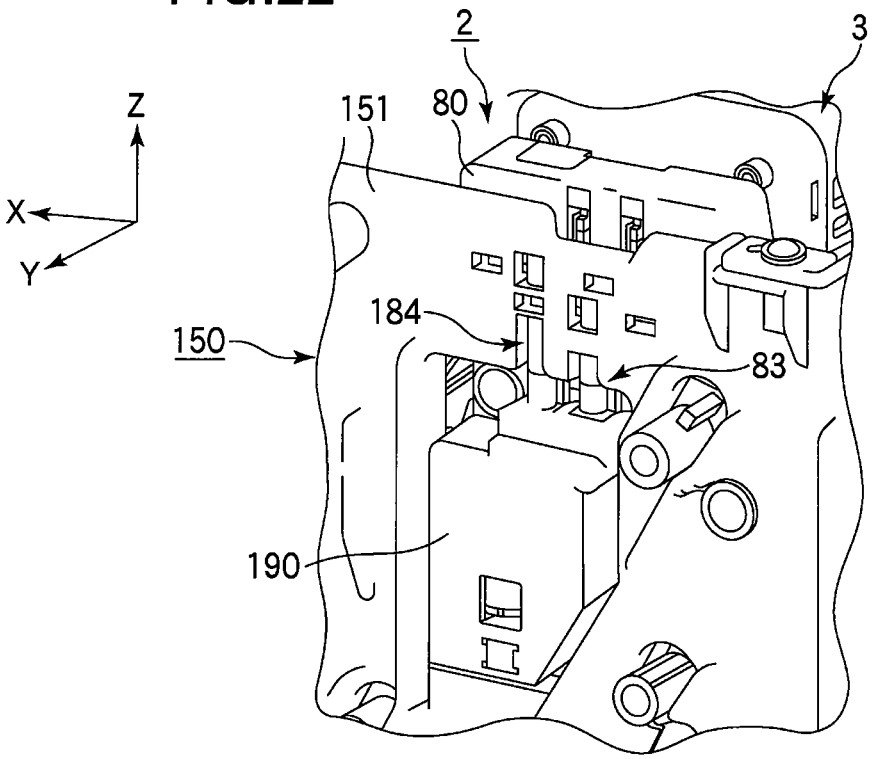
FIG. 22 illustrates the vicinity of the contact springs when the developing unit is in the non-idle position with the toner cartridge mounted thereon and the cover plate attached to the side frame.

FIG. 22 illustrates the vicinity of the urging springs 183 and 184 when the developing unit 2 attached to the basket 150 is in the non-idle position with the toner cartridge attached thereon and the cover plate 190 attached to the side frame 151.

Figure 23:
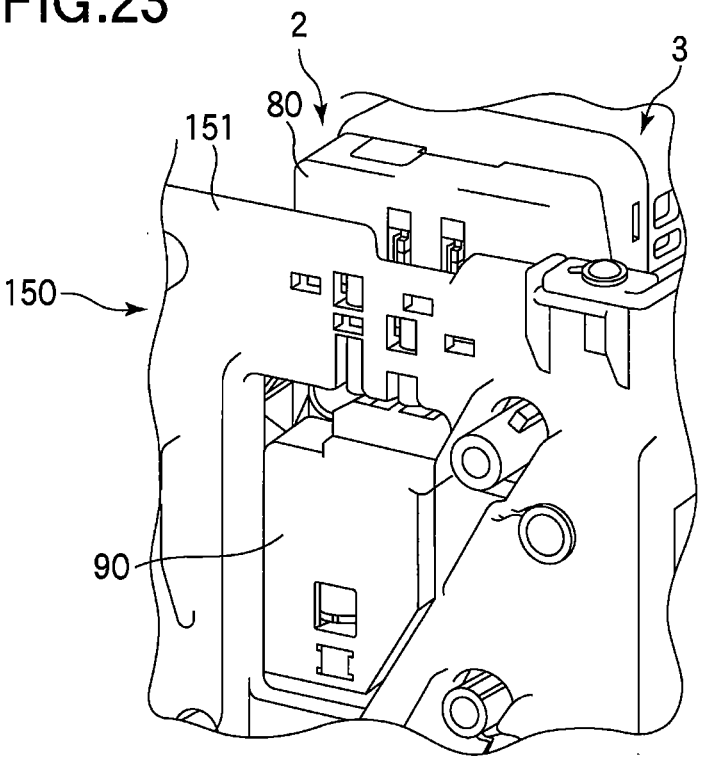
FIG. 23 illustrates the vicinity of the contact springs when the developing unit is in the idle position with the toner cartridge mounted thereon and the cover plate attached to the side frame.

FIG. 23 illustrates the vicinity of the urging springs 183 and 184 when the developing unit 2 attached on the basket 150 is in the idle position with the toner cartridge attached thereon and the cover plate 190 attached to the side frame 151.

When the toner cartridge 3 has been attached to the developing unit 2 of the developing apparatus 50, the contacts 172 and 173 (FIG. 14) are in contact with the ends 81*a* and 82*a* (FIG. 15), respectively, to make electrical connection. The compressed coil springs 81*b* and 82*b* and the third portions 183*c* and 184*c* fit over the coil spring posts 85 and 86, respectively, so that the compressed coil springs 81*b* and 82*b* are in pressure contact with the third portions 183*c* and 184*c* to make electrical connection therebetween. The cover plate 190 is attached to the first side frame 151 so that the ribs 190*a* and 190*b* move into engagement with the hooks 85*b* and 86*b* to hold the compressed coil springs 81*b* and 82*b* and the third portions 183*c* and 184*c* firmly in position.

The urging springs 183 and 184 can be compressed at different compression levels substantially in the directions in which the developing unit 2 moves along the elongate guide openings 152*a* and 152*b*. The first portions 183*a* and 184*a* are electrically connected to the conductive wires 180 and 181, which in turn are electrically connected to the contact springs 200 and 201 (FIG. 21).

The above-described structure allows the developing unit 2 to move up and down between the idle position and the non-idle position while the second portions 183*b* and 184*b* remain compressed. The structure holds the projection 80*a* of the developing unit 2 urged against the lower wall of the elongate guide opening 151*a* without rattling while maintaining electrical connection between the contact 172 and the contact spring 200 and electrical connection between the contact 173 and the contact spring 201 when the developing unit 2 moves between the idle position and non-idle position and when the developing unit 2 is in the idle position.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A developing apparatus for use in an electrophotographic image forming apparatus, comprising:

a plurality of developing units configured to form corresponding developer images;

a frame configured to hold the plurality of developing units therein in position, the developing units being movable independently by a distance relative to the frame; and an elastic sealing member secured to the frame and disposed between a side plate of each developing unit and the frame to seal a gap between the side plate and the frame after the developing unit has been attached to the frame, wherein when the developing unit moves over the distance relative to the frame, the elastic sealing member is deformable so that a surface of the elastic sealing member in contact with the side plate follows movement of the developing unit without slipping; wherein each of the developing units includes a first transporting path configured to transport developer, and the frame includes a second transporting path configured to communicate with the first transporting path and to transport the developer further when a corresponding developing unit has been attached to the frame;

the elastic sealing member seals a gap between the first transporting path and the second transporting path when the corresponding developing unit is attached to the frame; and the sealing member is compressed so that the sealing member, the gap, and the distance are related by $T \geq L1+L2$, where T is the thickness of the sealing member when it is not compressed, L1 is the distance, and L2 is the gap.

2. An image forming apparatus which includes the developing apparatus according to claim 1.

3. The developing apparatus according to claim 1, further comprising an urging member configured to urge each of the developing units against the frame.

4. The developing apparatus according to claim 3, wherein the urging member is a coil spring that is mounted across the frame and each of the developing units;

the developing units are configured to support corresponding developer holding devices detachably attached to the developing units, each developer holding device including a memory element; and the urging member is electrically conductive and includes a first portion and a second portion.

5. The developing apparatus according to claim 4, wherein each of the developer holding devices includes a first terminal and the frame includes a second terminal, wherein the urging member electrically connects the first terminal and the second terminal.

6. The developing apparatus according to claim 5, wherein the urging member includes a third portion electrically connected to the first terminal via a first conductive member, and a series connection of the first portion and second portion electrically connected to the second terminal via a second conductive member.

7. The developing apparatus according to claim 6, wherein the distance and the coil spring are related by $$L3 \geq L4+L1$$

where L3 is the length of the coil spring when the coil spring is relaxed, L4 is the length of the coil spring when the coil spring is fully compressed, and L1 is the distance.

8. The developing apparatus according to claim 6, wherein each of the developing units includes a projection that outwardly projects from each of the developing units, wherein the third portion and the first conductive member fit over the projection.

9. The developing apparatus according to claim 1, further comprising a movement mechanism configured to move the developing units.

10. A developing apparatus for use in an electrophotographic image forming apparatus, comprising:

a plurality of developing units configured to form corresponding developer images;

a frame configured to hold the plurality of developing units therein in position, the developing units being movable independently by a distance relative to the frame; and an elastic sealing member secured to the frame and disposed between a side plate of each developing unit and the frame to seal a gap between the side plate and the frame after the developing unit has been attached to the frame, wherein when the developing unit moves over the distance relative to the frame, the elastic sealing member is deformable so that a surface of the elastic sealing member in contact with the side plate follows movement of the developing unit without slipping; and an urging member configured to urge each of the developing units against the frame;

wherein the urging member is a coil spring that is mounted across the frame and each of the developing units;

each of the developing units includes a first transporting path configured to transport waste developer, and the frame includes a second transporting path configured to communicate with the first transporting path and to transport the waste developer further when a corresponding developing unit has been attached to the frame the elastic sealing member seals a gap between the first transporting path and the second transporting path when the corresponding developing unit is attached to the frame; and the sealing member is compressed so that the sealing member, the gap, and the distance are related by $T \geq L1+L2$, where T is the thickness of the sealing member when it is not compressed, L1 is the distance, and L2 is the gap.

11. An image forming apparatus which includes the developing apparatus according to claim 10.

12. A developing apparatus for use in an electrophotographic image forming apparatus, comprising:

a plurality of developing units configured to form corresponding developer images;

a frame configured to hold the plurality of developing units therein in position, the developing units being movable independently by a distance relative to the frame; and an elastic sealing member secured to the frame and disposed between a side plate of each developing unit and the frame to seal a gap between the side plate and the frame after the developing unit has been attached to the frame, wherein when the developing unit moves over the distance relative to the frame, the elastic sealing member is deformable so that a surface of the elastic sealing member in contact with the side plate follows movement of the developing unit without slipping;

an urging member configured to urge each of the developing units against the frame;

wherein the urging member is a coil spring that is mounted across the frame and each of the developing units;

the developing units areconfigured to support corresponding developer holding devices detachably attached to the developing units, each developer holding device including a memory element; and the urging member is electrically conductive and includes a first portion and a second portion.

13. The developing apparatus according to claim 12, wherein each of the developer holding device includes a first terminal and the frame includes a second terminal, wherein the urging member electrically connects the first terminal and the second terminal.

14. The developing apparatus according to claim 13, wherein the urging member includes a third portion electrically connected to the first terminal via a first conductive member, and a series connection of the first portion and second portion electrically connected to the second terminal via a second conductive member.

15. The developing apparatus according to claim 14, wherein the distance and the coil spring are related by $$L3 \geq L4 + L1$$

where L3 is the length of the coil spring when the coil spring is relaxed, L4 is the length of the coil spring when the coil spring is fully compressed, and L1 is the distance.

16. The developing apparatus according to claim 14, wherein each of the developing units includes a projection that outwardly projects from each of the developing units, wherein the third portion and the first conductive member fit over the projection.

* * * * *